United States Patent [19]

Keller, Jr.

[11] Patent Number: 4,486,018

[45] Date of Patent: Dec. 4, 1984

[54] PUZZLE AND TRANSPARENT CONTAINER THEREFORE

[76] Inventor: Claude E. Keller, Jr., c/o Kelberg Puzzle Co., 1318 East State St., Rockford, Ill. 61108

[21] Appl. No.: 474,516

[22] Filed: Mar. 11, 1983

[51] Int. Cl.[3] ..... A63F 9/10

[52] U.S. Cl. ..... 273/157 R; 206/315.1; 206/564; 220/377

[58] Field of Search ..... 273/157 R, 285; 206/44 B, 315.1, 564, 579, 451; 220/377

[56] References Cited

U.S. PATENT DOCUMENTS

| | | | |
|---|---|---|---|
| 760,384 | 5/1904 | Dieterich | 273/157 R |
| 979,923 | 12/1910 | Boore et al. | 273/157 R |
| 1,430,778 | 10/1922 | Williams | 273/285 |
| 1,441,386 | 1/1923 | Truskowski | 273/285 X |
| 1,948,962 | 2/1934 | Decker | 273/157 R |
| 1,972,206 | 9/1934 | Thomay | 273/157 R |
| 2,041,030 | 5/1936 | Strutton | 273/157 R |
| 2,529,321 | 11/1950 | Warren | 273/157 R |
| 2,586,017 | 2/1952 | Freedman | 273/282 |
| 2,984,489 | 6/1961 | Parlato | 273/157 R |
| 3,433,485 | 3/1969 | Renn et al. | 273/157 R |
| 3,504,915 | 4/1970 | Walker | 273/157 R |
| 3,593,434 | 7/1971 | McGarry . | |
| 3,679,213 | 7/1972 | Moss | 273/156 |
| 4,111,425 | 9/1978 | Lathrop | 273/157 R |
| 4,302,013 | 11/1981 | Kavis | 273/157 R |
| 4,307,886 | 12/1981 | Kemper | 273/239 |

FOREIGN PATENT DOCUMENTS

| | | | |
|---|---|---|---|
| 633951 | 12/1949 | United Kingdom | 273/157 R |

OTHER PUBLICATIONS

"Wordless Wordshop", Popular Science, Dec. 1976, p. 120.

*Primary Examiner*—Anton O. Oechsle

*Attorney, Agent, or Firm*—Leydig, Voit, Osann, Mayer & Holt, Ltd.

[57] ABSTRACT

A puzzle assembly having a plurality of pieces which are identical and which interfit without interlocking are assembled in a recess of the base of a container and the container is closed by a cover hinged to the base. When the cover is closed, the puzzle pieces are disposed between top and bottom walls formed respectively on the cover and the base. The pieces are made of a resiliently yieldable material and their normal thickness is greater than the spacing between the walls when the cover is closed so that the pieces are clamped between the walls and are held against sliding even though only some of the pieces have been assembled. The puzzle has a design on both sides and the top and bottom walls are transparent so that both designs may be viewed with the cover closed.

5 Claims, 6 Drawing Figures

PUZZLE AND TRANSPARENT CONTAINER THEREFORE

BACKGROUND OF THE INVENTION

This invention relates to puzzles of the type made up of a plurality of pieces which interfit to form a flat composite with a graphic design or representation on at least one side of the puzzle. More particularly, the invention relates to a puzzle of the type in which the pieces may be both stored and assembled in a container.

SUMMARY OF THE INVENTION

The principal object of the invention is to provide a puzzle and a container which coact in a novel manner so that, when the container is closed, it holds in place those puzzle pieces which have been assembled even though this is less than all of the pieces.

A more detailed object is to achieve the foregoing by using a container which comprises a base and a cover hinged together and respectively having a bottom wall and a top wall which are spaced apart a predetermined distance and by making the pieces from a resiliently compressible material and of a thickness greater than the spacing between the top and bottom walls so that these walls compress and clamp the pieces when the cover is closed.

Another object is to make at least one of the walls transparent so that the design on the puzzle may be viewed when the cover is closed.

Still another object is to provide such a puzzle with two designs, one on each side, and to make both the top and bottom walls transparent so that both designs may be viewed as the puzzle is being assembled simply by closing the cover and turning the container over.

The invention also resides in the novel details of the construction of the container and in the cooperation of the container and the puzzle pieces.

DETAILED DESCRIPTION OF THE PREFERRED EMBODIMENT

Figure 1:
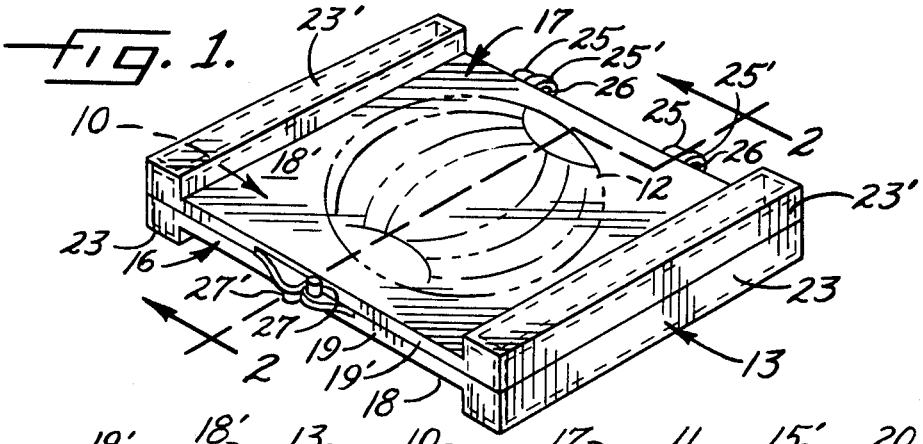
FIG. 1 is a perspective view of a puzzle assembly embodying the present invention.
Figure 2:
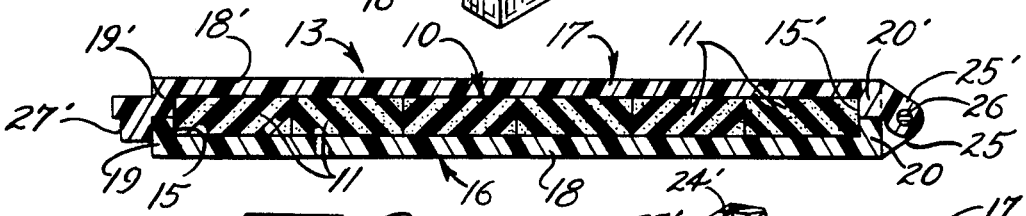
FIG. 2 is an enlarged sectional view taken along the line 2—2 in FIG. 1.

As shown in the drawings for purposes of illustration, the invention is embodied in a puzzle 10 made up of a plurality of interfitting pieces 11 (FIG. 3) which, when assembled together, form a flat composite with a graphic design representation such as the ball 12. Often, the puzzle pieces are of irregular shape so as to interlock and fit together in only one combination irrespective of the graphic representation, this being commonly known as a jig-saw puzzle. In the illustrated form, however, the pieces are identical in shape and are squares and the puzzle pieces are adapted to be assembled together in a container 13 which also is used to store the pieces.

Figure 4:
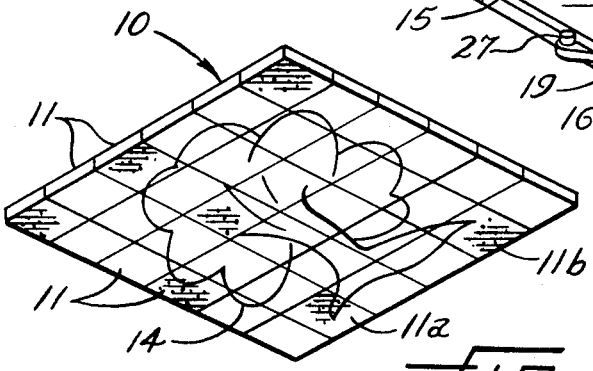
FIG. 4 is a perspective view of the underside of the puzzle.

In accordance with the present invention, the puzzle pieces 11 and the container 13 are constructed and coact in a novel manner so that, when the container is closed, it holds in place those pieces which have been assembled even though this is less than all the pieces. Further, the container is made so that the puzzle may, as it is assembled, be viewed with the container closed and, more particularly, the container is constructed so that both sides of the puzzle may be viewed as the interfitting of the pieces progresses thereby making it possible to correctly assemble a two-sided puzzle, that is, a puzzle which has a representation 14 (FIG. 4) on the reverse side of the representation 12. To achieve the foregoing, the puzzle pieces are made of a yieldably compressible material and are assembled in a flat recess 15 in the container so that they are compressed and held in place when the container is closed.

Figure 3:
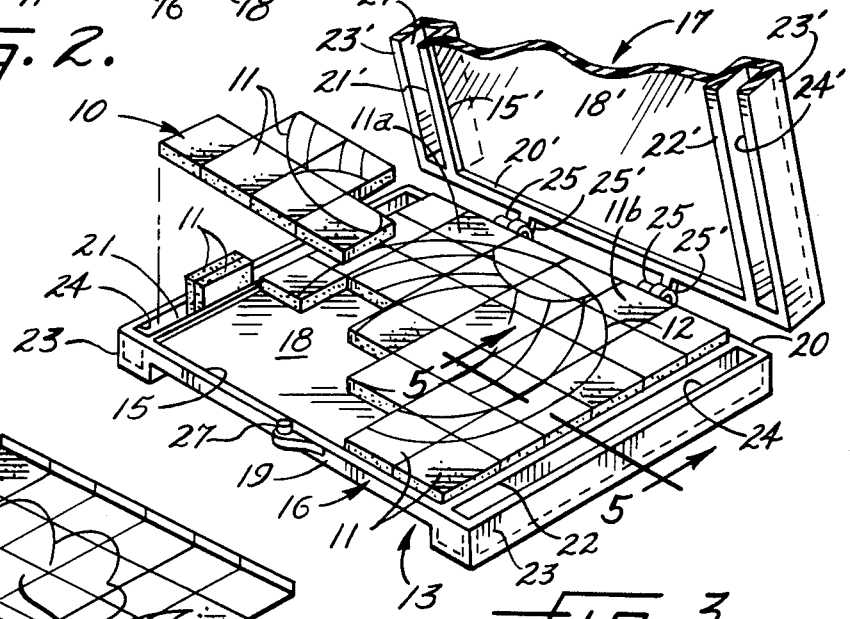
FIG. 3 is a fragmentary perspective view similar to FIG. 1. but showing the cover in the open position.

Herein, the container 13 comprises two identical parts 16 and 17 molded from a rigid plastic material with the part 16 serving as the base of the container and the part 17 being the cover. The base is rectangular and generally flat with the recess 15, which is square and opens upwardly, being defined by a bottom wall 18 and by upstanding front, back and side walls 19, 20, 21 and 22 at the periphery of the bottom wall. Elongated rectangular legs 23 are formed alongside the side walls 21 and 22 and depend below the bottom wall 18. The legs are hollow and define pockets or wells 24 which open upwardly and may be used to store puzzle pieces 11 as the puzzle is being put together on the bottom wall 18 (see FIG. 3). The cover 17, being identical to the base, includes a downwardly facing recess 15' which overlies the recess 15 when the cover is closed and which is defined by a top wall 18' and by front, back and side walls 19', 20', 21' and 22'. Hollow ribs 23' corresponding to the legs are molded alongside the side walls 21' and 22' and define downwardly opening wells 24' which coact with the wells 24 to form closed compartments for the puzzle pieces. A pair of hinge ears 25 is molded on the outside of the back wall 20 of the base 16 and are alined with similar ears 25' on the cover wall 22' and a hinge pin 26 projects through each set of alined ears so that the cover swings on the base about a horizontal axis between the open and closed positions as illustrated in FIGS. 3 and 1 respectively. Lugs 27 and 27' molded respectively on the outsides of the front walls 19 and 19' of the base and the cover frictionally engage the opposite front walls to hold the cover in the closed position.

Figure 5:
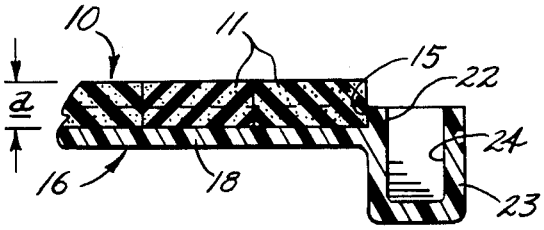
FIG. 5 is an enlarged fragmentary perspective view taken along the line 5—5 in FIG. 3.
Figure 6:
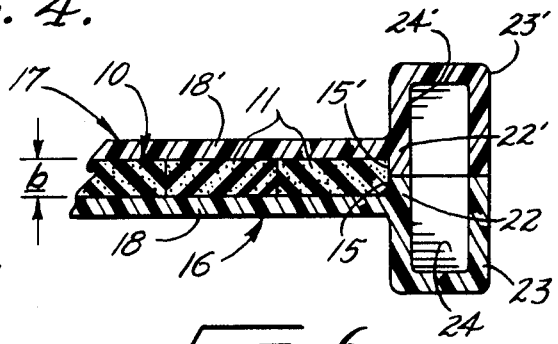
FIG. 6 is a view similar to FIG. 5 but shows the cover in the closed position.

As stated earlier, the puzzle pieces 11 are made of a yieldably compressible material, which herein may be a foam rubber or a foam plastic such as a cross-link polyethylene foam, and the pieces are cut from a sheet of such material. In the present instances, the pieces are square and are identical in size and shape. The natural thickness a (FIG. 5) of the pieces is greater than the depth of the recess 15 and, with the cover 17 and the base 16 being identical, this thickness is greater than the combined depths b (FIG. 6) of the recesses 15 and 15'. As a result, the pieces are compressed between the walls 18 and 18' when the cover is fully closed on the base and thus are restrained against sliding on the wall 18 even though the puzzle has been only partially completed.

Advantage is taken of the foregoing to permit the puzzle pieces 11 to be viewed while the cover 17 is closed and as the puzzle is being assembled. For this purpose, the top wall 18' is made of a transparent material so that the design 12, or such part of it as has been assembled, may, as shown in FIG. 1, be seen through the top wall when the cover is in the closed position. Preferably, the bottom wall 18 on the base 16 also is transparent to permit both the top and the bottom of the puzzle to be seen when the puzzle is partially completed and the cover is closed to prevent the pieces 11 from sliding out of place. With this arrangement, the puzzle may have a second design on the underside such as the tree 14 and may be properly pieced together to complete both the ball 12 and the tree. In such a puzzle, one design, such as the ball, may be symmetrical while the other design, such as the tree, may not be. As a result, some of the pieces such as the pieces 11*a* and 11*b* may have the same marking on the side of the ball and appear to be identical when viewed from this side but they do not have the same markings for the tree design on the other side and they are not interchangeable. When pieces such as these two are being assembled, therefore, the cover may be closed to hold the pieces in place and the bottom of the puzzle viewed to determine whether the pieces are positioned properly for both sides of the puzzle. In the preferred form of the invention, both the base 16 and the cover 17 are molded from a clear plastic material so that not only the top and bottom walls 18' and 18 are transparent but all other parts of the container 13 are also transparent. With the cover and the base being identical in construction, either may serve as the base and the other as the cover. In other words, the puzzle may be begun by assembling the pieces in the recess 15 with the design 12 facing up. Part way through the assembly of the pieces, the cover may be closed, the container turned upside down and opened and work on the puzzle may continue in the recess 15' with the design 14 facing up.

It will be observed that, with a puzzle assembly made according to the invention, only some of the pieces 11 may have been assembled and these pieces will be held in place when the cover 17 is closed by being compressed between the top and bottom wall 18' and 18. With the capability of holding a partially completed puzzle together, the assembly can be adapted for a two-sided puzzle by making the top and bottom walls transparent. Thus, after each piece is tentatively set in place to match the design 12 on the top side, the cover is closed and the container 13 is turned over to see if the piece matches the design 14 on the reverse side. In addition, the wells 24 provide convenient places to store the puzzle pieces before they are set in place. Also, the container may be stood upright on one pair of legs 23 and ribs 23' so that, when the designs as assembled are turned ninety degrees from that shown in the drawings, the container serves as a free-standing display for the cover.

I claim:

1. A puzzle assembly comprising, a base having an upwardly opening recess defined by a flat bottom wall and a side wall of predetermined height, said recess having a predetermined configuration as defined by said side wall, a plurality of puzzle pieces adapted to interfit and form a completed puzzle substantially filling said recess, said pieces being made of a yieldably compressible material and each having a thickness greater than twice the height of said side wall whereby the upper surfaces of the pieces are disposed above the side wall when the pieces are in said recess lying on said bottom wall, a cover movable relative to said base between an open position and a closed position in which the cover overlies said recess, said cover including a transparent top wall having the same size and configuration as said bottom wall and engageable with said puzzle pieces when said cover is in said closed position whereby the pieces are compressed and held in place by the top wall and may be viewed through the latter, said bottom wall also being transparent whereby pieces on the bottom wall may also be observed through the latter, and first and second graphic representations, one on each side of the completed puzzle with one representation showing through said top wall and the other through said bottom wall, said cover being identical with said base and including an identical recess whereby, when the puzzle is partially assembled, the cover may be closed to compress the pieces and hold the latter in place and the assembly may be turned over so that the assembly may be continued in the other recess with the other representation facing up.

2. A puzzle assembly comprising, a base having an upwardly opening recess defined by a flat bottom wall and a side wall of predetermined height, said recess having a predetermined configuration as defined by said side wall, a plurality of puzzle pieces adapted to interfit and form a completed puzzle substantially filling said recess, said pieces being made of a yieldably compressible material and each having a thickness greater than twice the height of said side wall whereby the upper surfaces of the pieces are disposed above the side wall when the pieces are in said recess lying on said bottom wall, a cover hinged at one edge to said base to swing between an open position and a closed position in which the cover overlies said recess, said cover including a transparent top wall having the same size and configuration as said bottom wall and engageable with said puzzle pieces when said cover is in said closed position whereby the pieces are compressed and held in place by the top wall and may be viewed through the latter, said bottom wall also being transparent whereby pieces on the bottom wall may also be observed through the latter, and first and second graphic representations, one on each side of the completed puzzle with one representation showing through said top all and the other through said bottom wall, said cover being identical with said base and including an identical recess whereby, when the puzzle is partially assembled, the cover may be closed to compress the pieces and hold the latter in place and the assembly may be turned over so that the assembly may be continued in the other recess with the other representation facing up.

3. A puzzle assembly as defined in claim 2 in which said base and said cover are molded of a transparent plastic material.

4. A puzzle assembly as defined in claim 2 in which elongated legs extend along the sides of the recess in said base and elongated legs extend along the sides of the recess in said cover whereby when the cover is in said closed position opposing legs form a base to support the assembly with the puzzle in a vertical plane.

5. A puzzle assembly as defined in claim 4 in which said legs are hollow to provide wells in which said puzzle pieces may be stored before they are assembled.

* * * * *